US005942015A

United States Patent [19]

Culler et al.

[11] Patent Number: 5,942,015

[45] Date of Patent: Aug. 24, 1999

[54] ABRASIVE SLURRIES AND ABRASIVE ARTICLES COMPRISING MULTIPLE ABRASIVE PARTICLE GRADES

[75] Inventors: Scott R. Culler, Burnsville, Minn.; Michael V. Mucci, Hudson, Wis.

[73] Assignee: 3M Innovative Properties Company, St. Paul, Minn.

[21] Appl. No.: 08/987,496

[22] Filed: Dec. 9, 1997

Related U.S. Application Data

[63] Continuation-in-part of application No. 08/931,228, Sep. 16, 1997, abandoned.

[51] Int. Cl.[6] ..... B24D 11/00

[52] U.S. Cl. ..... 51/295; 51/294; 51/297

[58] Field of Search ..... 51/293, 294, 295, 51/297

[56] References Cited

U.S. PATENT DOCUMENTS

| | | | |
|---|---|---|---|
| 875,936 | 1/1908 | Landis . | |
| 2,410,506 | 11/1946 | Kirchner et al. | 51/298 |
| 3,175,894 | 3/1965 | Foot | 51/298 |
| 4,364,746 | 12/1982 | Bitzer et al. | 51/298 |
| 4,644,703 | 2/1987 | Kaczmarek et al. | 51/401 |
| 4,734,104 | 3/1988 | Broberg | 51/295 |
| 4,737,163 | 4/1988 | Larkey | 51/295 |
| 5,011,512 | 4/1991 | Wald et al. | 51/295 |
| 5,022,895 | 6/1991 | Wiand | 51/295 |
| 5,039,311 | 8/1991 | Bloecher | 51/295 |
| 5,090,968 | 2/1992 | Pellow | 51/293 |
| 5,107,626 | 4/1992 | Mucci | 51/281 |
| 5,152,917 | 10/1992 | Pieper et al. | 51/295 |
| 5,207,759 | 5/1993 | Mehmandoust et al. | 51/281 |
| 5,219,462 | 6/1993 | Bruxvoort et al. | 51/293 |
| 5,304,223 | 4/1994 | Pieper et al. | 51/293 |
| 5,314,514 | 5/1994 | Sato | 51/295 |
| 5,342,419 | 8/1994 | Hibbard | 51/308 |
| 5,378,251 | 1/1995 | Culler et al. | 51/295 |
| 5,454,750 | 10/1995 | Cosmano et al. | 451/526 |
| 5,454,844 | 10/1995 | Hibbard et al. | 51/295 |
| 5,496,387 | 3/1996 | Culler | 51/295 |
| 5,500,273 | 3/1996 | Holmes et al. | 428/147 |
| 5,549,962 | 8/1996 | Holmes et al. | 428/144 |
| 5,551,960 | 9/1996 | Christianson | 51/295 |
| 5,639,284 | 6/1997 | Ryoke et al. | 51/297 |
| 5,647,879 | 7/1997 | Kubo | 51/307 |
| 5,656,045 | 8/1997 | Wiand | 51/295 |
| 5,695,533 | 12/1997 | Kardys et al. | 51/295 |
| 5,792,544 | 8/1998 | Klein | 428/143 |

FOREIGN PATENT DOCUMENTS

| | | |
|---|---|---|
| 4-141377 | 5/1992 | Japan . |
| WO 97/06926 | 2/1997 | WIPO . |

*Primary Examiner*—Deborah Jones
*Attorney, Agent, or Firm*—Paul W. Busse; Scott R. Pribnow

[57] ABSTRACT

Abrasive slurries, abrasive articles made from the abrasive slurries, and methods for the production of the abrasive articles are disclosed. The abrasive slurries and abrasive articles made therefrom comprise at least two grades of abrasive particles (i.e., a first larger grade, and a second smaller grade). The abrasive grades have a median particle size ratio of about 2, where the median particle size ratio equals the median particle size of the larger grade of abrasive particles divided by the median particle size of any smaller grade of abrasive particles.

35 Claims, 3 Drawing Sheets

ABRASIVE SLURRIES AND ABRASIVE ARTICLES COMPRISING MULTIPLE ABRASIVE PARTICLE GRADES

This is a continuation-in-part of U.S. Ser. No. 08/931,228, filed on Sep. 16, 1997, now abandoned.

BACKGROUND OF THE INVENTION

1. Field of the Invention

This invention relates to abrasive slurries, abrasive articles made employing the abrasive slurries, and to methods of making abrasive articles.

2. Background

In general, abrasive articles comprise a plurality of abrasive particles bonded either together (e.g., a bonded abrasive or grinding wheel) or to a backing (e.g., a coated abrasive). These abrasive articles have been utilized to abrade and finish workpieces for over a hundred years. One problem that has faced the abrasive industry is the generally inverse relationship associated between the cut rate (i.e., the amount of a workpiece removed for a given time interval) and the surface finish that is imparted by the abrasive article on the workpiece surface. This explains why there exists a wide range of abrasive products from coarse grit (i.e., relatively large particle size of abrasive particles) to fine grit (i.e., relatively small particle size of abrasive particles). Typically, these types of abrasive products are sequentially used in an abrading operation to achieve both the desired cut and the desired surface finish.

One solution to the problem described above is disclosed in U.S. Pat No. 5,152,917 (Pieper et al.). Pieper et al. disclose a structured abrasive article that provides both a high rate of cut and a consistent surface finish in the workpiece surface. The structured abrasive coating comprises abrasive composites that are bonded to a backing and that have a precise shape. Pieper et al. disclose that an abrasive article with a precise spacing of pyramidal shaped composites provides a high cut rate and fine surface finish. The abrasive composites of Pieper et al. comprise a plurality of abrasive particles dispersed in a binder.

A challenge in producing structured abrasive articles is to control the physical properties of the abrasive composites in order to provide an abrasive article which has both a long service life and a high rate of cut. When in use in an abrading operation, structured abrasive articles erode, that is, they gradually and controllably expose new abrasive particles to the workpiece being abraded. In order to provide an abrasive article with a long life and a high rate of cut, the rate of erosion of the abrasive composite must be controlled. If the rate of erosion is too high, the abrasive article will have a short useful life. If the rate of erosion is too low, the exposed abrasive particles will dull resulting in a low rate of cut.

The rate of erosion of a composite is affected, at least in part, by the size of the abrasive particles in the composite, and the distribution of abrasive particles throughout the composite. As larger abrasive particles are used (i.e., for coarser abrasive articles) the amount of binder holding the abrasive particles together in the abrasive composite is decreased. This results in a weaker abrasive composite, having a higher rate of erosion and shorter useful life. Additionally, if the abrasive slurry used to form the abrasive composite is not stable, the abrasive particles contained therein may not remain substantially uniformly distributed throughout the binder. This may result in an abrasive coating being formed which has a non-uniform distribution of binder and abrasive particles. Such an abrasive coating may have a high rate of erosion due, at least in part, to a high concentration of abrasive particles being present with inadequate binder to bond the particles together.

In view of the foregoing, it is desirable to produce an abrasive article which has both a high rate of cut, (i.e., such as would be provided by using larger sized abrasive particles), while maintaining a long useful life. Furthermore, it is desirable to produce an abrasive slurry in which the abrasive particles contained therein remain substantially uniformly dispersed for a reasonable period of time.

SUMMARY OF THE INVENTION

The present invention provides abrasive slurries, abrasive articles made from the abrasive slurries, and representative methods of making the abrasive articles slurries.

In a first aspect, the present invention provides an abrasive slurry suitable for use in forming an abrasive coating of an abrasive article or composite particles. The abrasive slurry comprises:

(a) a binder precursor;

(b) a plurality of abrasive particles having a Mohs' hardness of 7 or greater dispersed in the binder precursor, the plurality of abrasive particles comprising at least:

(1) a first (larger) grade of abrasive particles having a first median particle size; and (2) a second (smaller) grade of abrasive particles having a second median particle size;

where the median particle size ratio is about 2 or greater.

The abrasive slurry comprises a binder precursor. As used herein "binder precursor" refers to a flowable or unsolidified material which can be converted to a solid binder. Conversion of the binder precursor to a binder involves a curing or solidification process. As used herein "curing" refers to a polymerization, crosslinking, drying, and/or gelling process. The most preferred binder precursors are free radically polymerizable resins such as, for example, acrylates and methacrylates.

An abrasive slurry of the present invention further comprises abrasive particles having a Mohs' hardness of greater than 7. As used herein "Mohs' hardness" refers to a scale which indicates the relative hardness of a material. The Mohs' hardness scale ranges from 1 to 10, with 1 being the softest, and 10 being the hardest. Examples of abrasive particles having a Mohs' hardness greater than 7 include fused aluminum oxide, ceramic aluminum oxide, silicon carbide, diamond, or cubic boron nitride.

An abrasive slurry of the present invention further comprises at least two distinct grades of abrasive particles (i.e., a first larger grade, and a second smaller grade). As used herein "grade" refers to a specific distribution of abrasive particles wherein the allowable weight fraction (or weight percentage) of each of several abrasive particle size ranges contained in the grade are specified. One measurement of the size of a sample of graded abrasive particles is the median particle size or $D_{50}$. As used herein "median particle size" or "$D_{50}$" for a sample of abrasive particles is equal to the abrasive particle size (typically specified as a diameter) for which 50% of the volume of the sample comprises abrasive particles which are smaller than the median volume particle size. As used herein "median particle size ratio" or "D50 ratio" refers to the median particle size of the larger grade of abrasive particles in the slurry divided by the median particle size of any smaller grade of abrasive particles in the slurry. For example, in an abrasive slurry comprising first and second abrasive particle grades having median particle sizes of 100 micrometer and 50 micrometers, respectively, the median particle size ratio or $D_{50}$ ratio is equal to 2. In an abrasive slurry of the present invention, the median particle size ratio is about 2 or greater, more preferably about 3 or greater, most preferably about 5 or greater, and particularly most preferably about 7 or greater. It is also within the scope of the present invention to have more than two abrasive particle grades in the abrasive article. For example, the abrasive particle size distribution may contain three distinct grades of abrasive particle.

In an abrasive slurry of the present invention the mixture of at least two distinct grades of abrasive particles results in a distribution of abrasive particles sizes having at least two Gaussian-like, or bell-shaped curves. This distribution is evident when the particle size distribution is measured and displayed as a graph having particle size plotted along the x-axis, and the total number of particles having a given particle size plotted along the y-axis.

In a second aspect, the present invention provides an abrasive article having an abrasive coating made from an abrasive slurry of the present invention. The abrasive article comprises:

(a) a backing having a front and a back surface;

(b) an abrasive coating bonded to the front surface of the backing, the abrasive coating comprising:

(1) a binder;

(2) a plurality of abrasive particles having a Mohs' hardness of 7 or greater dispersed in the binder, the plurality of abrasive particles comprising at least:

(i) a first (larger) grade of abrasive particles having a first median particle size; and (ii) a second (smaller) grade of abrasive particles having a second median particle size;

where the median particle size ratio is about 2 or greater.

Typically the abrasive coating is provided as a continuous coating characterized by having an absence of a substantial number of unfilled pores or voids throughout. The abrasive coating may have any desired surface topography such as, for example, a smooth surface, a textured surface, a structured surface, or a surface comprising a plurality of composite particles.

As used herein "structured" means an abrasive article wherein the abrasive coating comprises a plurality of precisely shaped abrasive composites disposed on a backing in a predetermined array wherein each composite has a predetermined shape and comprises abrasive particles distributed in a binder. The predetermined array of abrasive composites may be either random or non-random. Structured abrasive articles having a non-random array are described in U.S. Pat. No. 5,152,917 (Pieper et al.), the disclosure of which is incorporated herein by reference. Structured abrasive articles having a random array are described in U.S. Pat. No. 5,681,217 (Hoopman et al.) the disclosure of which is incorporated herein by reference.

As used herein "textured" means a surface topography comprising a plurality of protuberances (i.e., ridges, peaks, mesas, and the like) or indentations. The plurality of protuberances and/or indentations may be regular or irregular in size, shape, orientation, and areal spacing. A textured surface may be formed, for example, by a gravure coating technique which produces a sinusoidal-like topography comprising a plurality of irregularly shaped, regularly repeating raised ridges.

The abrasive coating may also comprise a plurality of composite particles adhered to a backing by a make coat. The composite particles comprise an abrasive slurry of the present invention which has been cured to form distinct, free-flowing, individual particles. The composite particles may have precise shapes (i.e., cone, triangular prism, cylinder, pyramid, cube) or they may have irregular shapes. The composite particles are adhered to the front surface of a backing by a make coating. As used herein "make coat" refers to a coating which is applied to the backing for the purpose of adhering abrasive particles thereto. Optionally, additional coatings such as a size coat or supersize coat may be applied to further bond the abrasive composites to the backing or to provide other improved properties such as, for example, antiloading. Precisely shaped abrasive composite particles and abrasive articles made therefrom may be produced by the methods described in U.S. Pat. No. 5,500,273 (Holmes et al.), the disclosure of which is incorporated herein by reference.

The present invention provides abrasive articles which may have an improved useful life as compared with prior art abrasive articles and may provide an improved surface finish on a workpiece. An improved useful life is provided by reducing the rate of erosion of the abrasive coating. A reduced rate of erosion is particularly important for coarse grade structured abrasive articles which are prone to excessive erosion under severe grinding (abrading) conditions. It is believed that the addition of the smaller grade abrasive particles provides increased bonding area between the binder and the abrasive particles thereby resulting in an abrasive composite which is stronger and less prone to erosion under severe grinding conditions.

In a third aspect, the invention provides a method of making an abrasive article utilizing an abrasive slurry of the present invention. The method comprises the steps of:

(a) coating a backing sheet with an abrasive slurry of the present invention; and (b) subjecting the abrasive slurry to conditions sufficient to at least partially solidify the binder precursor.

The abrasive coating may have any desired surface topography, such as, for example, a smooth surface, a textured surface, or a structured surface. A textured abrasive surface may be provided, for example, by contacting the slurry-coated front surface of the backing with a texturing roll such as, for example, a gravure cylinder.

In a fourth aspect, the invention provides a preferred method of making an abrasive article comprising the steps of:

(a) providing a production tool having a major surface with a plurality of precisely shaped recesses formed therein;

(b) filling the recesses with an abrasive slurry of the present invention;

(c) providing a backing having a front surface and a back surface;

(d) laminating the front surface of the backing to the surface of the production tool so that at least a portion of the front surface of the backing is in direct contact with the surface of the production tool;

(e) subjecting the abrasive slurry to conditions sufficient to at least partially cure the binder precursor; and (f) separating the backing from the production tool.

According to this method a production tool having a plurality of precisely shaped recesses is coated with an abrasive slurry of the present invention in order to fill the precisely shaped recesses. The front surface of a backing is then brought into contact with the abrasive slurry. While in contact, the abrasive slurry is exposed to conditions sufficient to at least partially cure or solidify the binder precursor of the abrasive slurry. Finally, the backing having the abrasive coating bonded thereon is removed from the precisely shaped surface of the production tool to yield a structured abrasive article.

Alternatively, an abrasive slurry of the present invention may be coated on the front surface of a backing. The slurry-coated front surface of the backing is then brought into contact with a production tool such that the slurry fills the precisely shaped recesses of the production tool. While in contact, the abrasive slurry is exposed to conditions sufficient to at least partially cure or solidify the binder precursor of the abrasive slurry. Finally, the backing having the abrasive coating bonded thereon is removed from the precisely shaped surface of the production tool to yield a structured abrasive article.

In yet another variation, the abrasive slurry-coated backing is removed from the precisely shaped surface prior to cure or solidification of the binder precursor (i.e., step (f) is performed prior to step (e)). The removal of the unsolidified slurry-coated backing from the precisely shaped surface may alter the topography of the abrasive coating so as to produce an abrasive coating having an irregular topography. Also, after separation, the unsolidified abrasive slurry may flow so as to produce an abrasive coating having an irregular topography.

In a fifth aspect, the present invention provides a method of making an abrasive article comprising the steps of:

(a) providing a production tool having a major surface said major surface having a plurality of precisely shaped recesses formed therein;

(b) filling said precisely shaped recesses with an abrasive slurry of the present invention;

(c) subjecting the abrasive slurry to conditions sufficient to at least partially cure the binder precursor so as to form individual composite particles;

(d) removing the precisely shaped composite particles from the precisely shaped recesses of the production tool;

(e) providing a backing having a front surface; and (f) adhering a plurality of the composite particles to the front surface of the backing.

According to this method distinct, free-flowing, individual composite particles are formed from an abrasive slurry of the present invention. Once formed, the precisely shape abrasive composite particles are adhered to the front surface of a backing with a make coat to provide an abrasive article.

Other advantages and aspects of the invention will be described in the description of preferred embodiments which follows.

DESCRIPTION OF PREFERRED EMBODIMENTS

Figure 1:
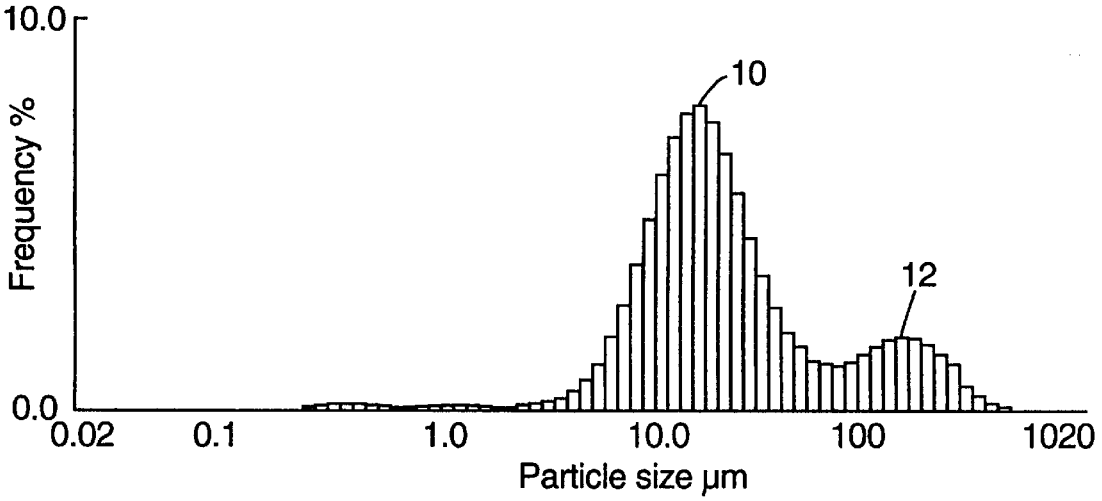
FIG. 1 is a graph showing a typical abrasive particle size distribution for an abrasive slurry or an abrasive article of the present invention.

The present invention pertains to abrasive slurries, abrasive articles made utilizing the abrasive slurries, and to methods of making the abrasive articles.

Abrasive slurries and abrasive articles of the present invention may have performance properties equal to or improved over previously known abrasive slurries and abrasive articles. For example, abrasive slurries of the present invention may have a reduced inorganic particle sedimentation rate compared with previously known abrasive slurries. Abrasive articles made from abrasive slurries of the present invention may provide performance advantages over previously known abrasive articles such as, for example, a longer useful life, and the ability, at least in some instances, to provide a finer (i.e., smoother) finish on a workpiece.

Abrasive Slurries

The present invention provides abrasive slurries which are suitable for forming an abrasive coating of an abrasive article. The abrasive slurries comprise a binder precursor, at least two distinct grades of abrasive particles (i.e., a first (larger) grade and a second (smaller) grade), and may further comprise optional ingredients such as curing agents, additives, fillers, grinding aids, coupling agents, and binder precursor additives.

Abrasive slurries of the present invention may remain as slurries (i.e., substantially free from settling) for days rather than hours thereby allowing the slurries to be stored for long periods of time (e.g., 3 days or longer) before they are coated onto backings. An advantage of utilizing a mixture of at least two grades of abrasive particles in an abrasive slurry is that the presence of the smaller grade of abrasive particles reduces the sedimentation rate of inorganic particles (defined to include both abrasive particles and any filler particles) from the abrasive slurry. An abrasive slurry of the present invention may have little or no compaction of inorganic particles on the bottom of the container for about 2 to about 5 days, preferably at least 3 days. This eliminates the need for constant agitation to coat the abrasive slurries. In many previously known slurries, as soon as agitation is stopped, the larger inorganic particles begin to settle and eventually become compacted at the bottom of the container. The compacted inorganic particles must be redispersed before the slurry may be used for the production of abrasive articles, a process which may be difficult and/or inconvenient.

Binder Precursors

Binder precursors are typically provided in a liquid or flowable form to allow an abrasive slurry containing the binder precursor to be coated. During the manufacture of the abrasive article, the binder precursor is exposed to the appropriate energy source (i.e., heat, ultraviolet radiation, visible radiation, electron beam) to convert (i.e., at least partially cure or solidify) the binder precursor into a solid binder. Conversion of a flowable or liquid binder precursor to a solid binder is typically the result of a curing or solidification process such as, for example, polymerization, crosslinking, gelling, or evaporation of a liquid from a binder dissolved or dispersed in the liquid (e.g., a polymer dissolved in a solvent). Mixtures of polymerizable binder precursors, crosslinkable binder precursors, and binders dissolved or dispersed in a liquid are also possible.

Preferred binders precursors can be either condensation curable resins or addition polymerizable resins. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof Ethylenically unsaturated binder precursors are characterized by having at least one polymerizable carbon-carbon double bond. Examples of ethylenically unsaturated binder precursors include aminoplast monomer or oligomers having pendant alpha, beta unsaturated carbonyl groups, ethylenically unsaturated monomers, oligomers, or diluents, acrylated isocyanurate monomers, acrylated urethane oligomers, acrylated epoxy monomers or oligomers, acrylate dispersions, or mixtures thereof.

Aminoplast monomer or oligomer binder precursors have at least one pendant alpha, beta-unsaturated carbonyl group per molecule, or per oligomer. These materials are described in U.S. Pat. Nos. 4,903,440 and 5,236,472, the disclosures or which are incorporated herein by reference.

Ethylenically unsaturated monomers or oligomers may be monofunctional, difunctional, trifunctional, tetrafunctional, or may have a functionality greater than tetra. Functionality refers to the number of polymerizable double carbon-carbon double bonds per molecule. The term "acrylate" includes both acrylates and methacrylates. Ethylenically unsaturated binder precursors include both monomeric and polymeric compounds that contain atoms of carbon, hydrogen and oxygen, and optionally, nitrogen and the halogens. Oxygen and nitrogen atoms, or both, are generally present in ether, ester, urethane, amide, and urea groups. Ethylenically unsaturated compounds preferably have a molecular weight of less than about 4,000 grams/mole, and are preferably esters made from the reaction of compounds containing aliphatic monohydroxy groups or aliphatic polyhydroxy groups with unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters, and amides of carboxylic acids, such as diallyl phthalate, diallyl adipate, and N,N-diallyladipamide. Still other nitrogen containing compounds include tris(2-acryl-oxyethyl)isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, incorporated herein after by reference. The preferred isocyanurate material is a triacrylate of tris(hydroxy ethyl) isocyanurate.

Acrylated urethanes are acrylate esters (typically diacrylate esters) of hydroxy terminated isocyanate extended polyesters or polyethers. Examples of acrylated urethanes include those commercially available under the trade designations "UVITHANE 782" (available from Morton Thiokol Chemical), "CMD 6600", "CMD 8400", or "CMD 8805" (available from UCB Radcure Specialties). Acrylated epoxies are acrylate esters (typically diacrylate esters) of epoxy resins such as, for example, the diacrylate esters of bisphenol A epoxy resin. Examples of acrylated epoxies include those commercially available under the trade designations "CMD 3500", "CMD 3600", or "CMD 3700" (available from UCB Radcure Specialties).

Epoxide binder precursors have an oxirane (epoxide) ring and are polymerized by ring opening. These materials can vary greatly in the nature of their backbones and substituent groups (groups pendant from the backbone). For example, the backbone may be of any type normally associated with epoxides and substituent groups thereon can be any group free of an active hydrogen atom that is reactive (or capable of being made reactive) with an oxirane ring at room temperature. Representative examples of acceptable substituent groups include halogens, ester groups, ether groups, sulfonate groups, siloxane groups, nitro groups, or phosphate groups. Examples of preferred epoxy resins lacking ethylenically unsaturated groups include 2,2-bis[4-(2,3-epoxypropoxy)-phenyl] propane (also known as diglycidyl ether of bisphenol A), and those commercially available under the trade designations "EPON 828", "EPON 1004", or "EPON 1001F" (available from Shell Chemical Co.), "DER-331", "DER-332", or "DER-334" (available from Dow Chemical Co.). Other suitable epoxy resins lacking ethylenically unsaturated groups include glycidyl ethers of phenol formaldehyde novolak resins commercially available under the trade designations "DEN-431", or "DEN-438." (available from Dow Chemical Co.).

Thermally curable binder precursors may be used in abrasive slurries of the present invention. Novolak phenolic resins having a molar ratio of aldehyde to phenol of less than 1:1 are one example. Examples of phenolics include those commercially available under the trade designations "DUREZ", or "VARCUM" (available from Occidental Chemicals Corp.), those commercially available under the trade designation "RESINOX" (available from Monsanto), and those commercially available under the trade designations "AEROFENE", or "AROTAP" (available from Ashland Chemical Co.).

Abrasive slurries of the present invention may further comprise a diluent. As used herein the term "diluent" connotes a low molecular weight (i.e., less than 500 grams/mole) organic material that may or may not decrease the viscosity of the binder precursor to which it is added. Diluents may be reactive with the binder precursor or inert.

Low molecular weight acrylates are one preferred type of reactive diluent. Preferred acrylate reactive diluents typically have a molecular weight ranging from about 100 to about 500 grams/mole, and include ethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate, or pentaerythritol tetramethacrylate. Methyl methacrylate or ethyl methacrylate may also be used.

Other useful reactive diluents include monoallyl, polyallyl, or polymethallyl esters, amides of carboxylic acids such as, for example, diallyl phthalate, diallyl adipate, or N,N-diallyladipamide), tris(2-acryloyl-oxyethyl) isocyanurate, 1,3,5-tri(2-methacryloxyethyl)-s-triazine, acrylamride, methylacrylamide, N-methylacrylamide, N,N-dimethylacrylamide, N-vinylpyrrolidone, or N-vinylpiperidone.

Abrasive Particles

Abrasive particles suitable for abrasive slurries of the present invention should be size graded to meet a desired or predetermined particle size distribution. For example, abrasive particles can be graded according to the standards set forth by the American National Standards Institute, Inc. (ANSI) standards. ANSI standards specify that the particle size distribution for each nominal grade must fall within numerically defined limits. According to the ANSI standards, any nominal grade is made up of three particle size fractions, a "control" fraction, an "overgrade" fraction (containing large particles nominally one fraction coarser than the control fraction), and a "fine" fraction (containing small particles finer than the control fraction). Additionally, ANSI standards may permit the inclusion of up to 0.5% weight of particles coarser than the overgrade fraction. The percentage of particles falling within each fraction varies from grade to grade; in general, however, about 50–60% weight are in the control fraction, about 10% weight are in the overgrade fraction, and about 30–40% weight are in the fine fraction. When considered as a total, the sum of the three fractions is referred to as "full grade." Abrasive particles may be separated into fractions by using screens having specific sized openings.

Grading systems employed outside of the United States vary somewhat as to the exact particle size, and the weight percentage of particles falling in the fractions that make up a "full grade." Like the ANSI system, the Japanese grading system (Japanese Industrial Standard (JIS)) employs three fractions, the European grading system (Federation of European Producers of Abrasive Products (FEPA)) effectively includes four fractions.

Abrasive particle grades (i.e., ANSI, JIS, and FEPA grades) typically have a Gaussian-like, or bell-shaped distribution, when particle size is plotted against the number of particles having a given particle size (i.e., particle size is plotted along the x-axis and the number of particles is plotted along the y-axis of a Cartesian coordinate system).

Various methods of measuring the size of abrasive particles are known to those skilled in the art. Any of the standard methods, such as screening, sedimentation, laser measurements, etc. could be used to measure the size of abrasive particles useful for the present invention. One method that is particularly suitable is based upon an instrument using the Fraunhofer-Mie method of calculation which determines particle size based on diffraction angles of two different light wavelengths passed through a circulating suspension of particles. This technique can be performed by commercially manufactured instruments, such as a Horiba LA-910 manufactured by Horiba Instruments, Inc. of Irvine, Calif. This technique measures particle size on a volume basis, meaning that the particle sizes determined by two-dimensional diffraction results are extrapolated to a three-dimensional volume output.

The particle size of a sample of graded abrasive particles can be characterized by the median particle size or $D_{50}$ of the abrasive particles in the sample. The median particle size of a sample of graded abrasive particles is equal to the particle size wherein 50% of the volume of all abrasive particles in the sample have a particle size less than the median particle size. For example, if the median particle size or $D_{50}$ of a sample is 25 micrometers and the total volume of all particles in the sample is 100 $cm^3$, then particles comprising 50% of the total volume of the sample (i.e., 50 $cm^3$) have a size less than 25 micrometers.

In an abrasive slurry of the present invention the abrasive particles comprise abrasive particles from at least two distinct grades. According to the present invention the median particle size ratio (defined as the median particle size of the larger grade of abrasive particles divided by the median particle size of any smaller grade of abrasive particles) is about 2 or greater. More preferably, the median particle size ratio is about 3 or greater. Most preferably, the median particle size ratio is about 5 or greater, and particularly most preferably the median particle size ratio is about 7 or greater. Therefore, if, for example, the first larger grade of abrasive particles has a median particle size of 60 micrometers, any second, smaller abrasive particle grade of abrasive particles must have a median particle size of 30 micrometers or less.

Referring now to FIG. 1, a graph of a typical particle size distribution for an abrasive slurry of the present invention is shown. Abrasive particle size is plotted along the x-axis of the coordinate system using a logarithmic scale. Frequency, which is proportional to the number of abrasive particles, is plotted along the y-axis of the coordinate system. The distribution of abrasive particles is represented by the histogram-style plot. The height of each histogram column is proportional to the number of abrasive particles in the size range designated on the x-axis. As shown in FIG. 1, the distribution of abrasive particle sizes has two distinct Gaussian-like or bell-shaped curves, the centers of which are designated as 10 and 12. The bell-shaped curve centered at 10 is due primarily to the smaller of the two abrasive particle grades in the abrasive slurry. The bell-shaped curve centered at 12 is due primarily to the larger of the abrasive particle grades in the abrasive slurry. The distance between the centers of the bell-shaped curves is proportional to the difference in median particle size of the two abrasive grades. Hence, the distance between the centers of the bell-shaped distributions 10 and 12 would be expected to increase as the median particle size ratio increases. The height (distance from the x-axis) of the bell-shaped curves is proportional to the number of abrasive particles. Therefore, as the amount of an abrasive particle grade in the abrasive slurry is increased, the bell-shaped curve corresponding to the abrasive particle grade will similarly increase in height.

It should be noted that although the median particle size ratio for any two grades of abrasive particles must be about 2 or greater, this does not preclude having abrasive particles of the same size in each grade. Since each abrasive particle grade comprises a distribution of abrasive particle sizes, overlap of the distributions is not precluded. For example, an abrasive grade having a $D_{50}$ of 30 micrometers and an abrasive grade having a $D_{50}$ of 60 micrometers may both contain abrasive particles having a size of 45 micrometers. As the $D_{50}$ ratio increases the range of particle sizes common to both grades decreases.

In abrasive slurries of the present invention the grades of abrasive particles should be provided in sufficient relative amounts in order to provide the potential for at least one improved property, such as, for example, a reduced slurry sedimentation rate, a longer abrasive article useful life, and/or the ability, at least in some instances, to provide a finer (i.e., smoother) finish on a workpiece. Typically, abrasive slurries containing two grades of abrasive particles comprise from about 10% to about 90% by weight of the larger grade of abrasive particles and from about 10% to about 90% of the smaller grade of abrasive particles. More preferably, the abrasive slurries comprise from about 25% to about 75% by weight of the larger grade of abrasive particles and from about 25% to about 75% by weight of the smaller grade of abrasive particles. Most preferably, the larger grade of abrasive particle is about 60% by weight and the smaller grade of abrasive particles is about 40% by weight. Abrasive slurries comprising more than two grades of abrasive particles typically comprise from about 10% to 50% by weight of the larger grade of abrasive particles and from about 50% to about 90% by weight for all smaller grades of abrasive particles. If there are two or more of the smaller abrasive particles grades, these grades may be present in equal or unequal amounts.

Abrasive particles of the present invention typically have a median particle size from about 0.1 to about 1500 micrometers, more preferably from about 0.1 to about 700 micrometers, most preferably from about 1 to about 250 micrometers, and particularly most preferably from about 1 to about 150 micrometers.

It is preferred that abrasive particles used in abrasive slurries or abrasive articles of the present invention have a Mohs' hardness of at least about 7, more preferably at least about 7.5, most preferably at least about 8, and particularly most preferably at least about 8.5. Mohs' hardness refers to a scale which measures the relative hardness of an abrasive particle. The Mohs' hardness scale ranges from 1 to 10, with 1 being the softest (i.e., having the hardness of talc) and 10 being the hardest (i.e., having the hardness of diamond).

Abrasive particles may be selected from those commonly used in abrasive articles, however, the abrasive particle size and composition will be chosen with the application of the abrasive article in mind. In choosing an appropriate abrasive particle, characteristics such as hardness, compatibility and reactivity with the intended workpiece, particle size, and heat conductivity may be considered.

Examples of suitable abrasive particles include boron carbide, cubic boron nitride, fused aluminum oxide, ceramic aluminum oxide, heat treated aluminum oxide, alumina zirconia, silicon carbide, iron oxides, tantalum carbide, cerium oxide, garnet, titanium carbide, synthetic and natural diamond, zirconium oxide, silicon nitride, or combinations thereof.

The abrasive particles may be irregular or may be shaped. Irregularly shaped particles are made, for example, by crushing the particles during some stage of the process. Shaped abrasive particles include rods (having any cross-sectional area), pyramids, and thin faced particles having polygonal faces. Shaped ceramic alumina abrasive particles and methods of making them are described, for example, in U.S. Pat. Nos. 5,090,968 (Pellow) and 5,201,916 (Berg et al.).

It is also possible to have a surface coating on the abrasive particles. Surface coatings may be used to increase the adhesion of the abrasive particle to the binder, to alter the abrading characteristics of the abrasive particles, or for other purposes. Examples of surface coatings are reported in U.S. Pat. Nos. 4,997,461 (Markhoff-Matheny et al.), 5,011,508 (Wald et al.), 5,131,926 (Rostoker), 5,213,591 (Celikkaya et al.), and 5,474,583 (Celikkaya).

Abrasive particles may also include agglomerates of individual abrasive particles. An abrasive agglomerate is formed when a plurality of abrasive particles are bonded together with a binder to form a larger abrasive particle which may have a specific particulate structure. The plurality of particles which form the abrasive agglomerate may comprise more than one type of abrasive particle, and the binder used may be the same as or different from the binders used to bind the agglomerate to a backing.

Curing Agents

Abrasive slurries of the present invention may further comprise a curing agent. A curing agent is a material that functions to initiate and complete a polymerization or crosslinking process, such that the initially flowable binder precursor is converted into a cured or solid binder. The term curing agent encompasses initiators, photoinitiators, catalysts and activators. The amount and type of the curing agent typically depends upon the chemical reactivity of the binder precursor.

Polymerization of the preferred ethylenically unsaturated monomers or oligomers occurs via a free-radical addition polymerization mechanism. Free radical polymerization may be initiated by an electron beam source, an ultraviolet radiation source, a visible radiation source, or a thermal source (i.e., heat). If an electron beam source is used, the electron beam directly generates free-radicals in the binder precursor thereby initiating polymerization without need for a chemical initiator. It is also within the scope of this invention, however, to use chemical initiators even if the binder precursor is exposed to an electron beam. If the energy source is heat, ultraviolet light, or visible light, a chemical initiator may be necessary in order to generate free-radicals to initiate the polymerization. Examples of chemical initiators that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of commercially available photoinitiators that generate free radicals upon exposure to ultraviolet light include those commercially available under the trade designation "IRGACURE 651", or "IRGACURE 184" (available from Ciba Geigy Company), and the photoinitiator available under the trade designation "DAROCUR 1173" (available from from Merck). Typically, chemical initiators are used in amounts from about 0.1% to about 10%, preferably from about 2% to about 4% by weight, based on the weight of the binder precursor. Additionally, it is preferred to uniformly disperse the chemical initiator in the binder precursor prior to the addition of any particulate material, such as abrasive particles and/or filler particles.

Optionally, the abrasive slurries may contain photosensitizers or photoinitiator systems which affect the polymerization of the binder precursor either in air or in an inert atmosphere, such as nitrogen. These photosensitizers or photoinitiator systems include compounds having carbonyl groups or tertiary amine groups, and mixtures thereof. Among the preferred compounds having carbonyl groups are benzophenone, acetophenone, benzil, benzaldehyde, o-chlorobenzaldehyde, xanthone, thioxanthone, 9,10-anthraquinone, or other aromatic ketones which can act as photosensitizers. Among the preferred tertiary amines are methyldiethanolamine, ethyldiethanolamine, triethanolamine, phenylmethylethanolamine, or dimethylaminoethylbenzoate.

Additives

Abrasive slurries of the present invention may further comprise optional additives such as plasticizers, abrasive particle surface modification additives, coupling agents, fillers, expanding agents, fibers, antistatic agents, initiators, suspending agents, photosensitizers, lubricants, wetting agents, surfactants, pigments, dyes, UV stabilizers, or suspending agents. The amounts of these materials are selected to provide the properties desired.

Examples of plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyols derivatives, t-butylphenyl diphenyl phosphate, tricresyl phosphate, castor oil, or combinations thereof.

Abrasive slurries of the present invention may further comprise surface modification additives such as wetting agents (i.e., surfactants) and coupling agents. A coupling agent can provide a bridge between the binder and the abrasive particles. Additionally the coupling agent can provide a bridge between the binder and the filler particles. Examples of coupling agents include silanes, titanates, and zircoaluminates. An example of a coupling agent found suitable for this invention is the methacryloxypropyl silane commercially available under the trade designation "A-174" (available from Union Carbide Corporation). Further examples which illustrate the use of silane, titanate, and zircoaluminate coupling agents are disclosed in U.S. Pat. Nos. 4,871,376 and 4,773,920.

Abrasive slurries of the present invention may further comprise fillers. A filler is a particulate material which has an average particle size from about 0.1 to about 50 micrometers, typically from about 1 to about 30 micrometers. Examples of useful fillers for this invention include metal carbonates such as calcium carbonate (e.g., chalk, calcite, marl, travertine, marble and limestone), calcium magnesium carbonate, sodium carbonate, or magnesium carbonate. Other examples include silica (e.g., quartz, glass beads, glass bubbles, glass fibers), silicates (e.g., talc, clays, montmorillonite, feldspar, mica, calcium silicate, calcium metasilicate, sodium aluminosilicate, sodium silicate), metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, tin oxide (stannic oxide), titanium dioxide), metal sulfites (e.g., calcium sulfite), thermoplastic particles (e.g., particles of polycarbonate, polyetherimide, polyester, polyethylene, polysulfone, polystyrene, acrylonitrile-butadiene-styrene block copolymer, polypropylene, acetal polymers, polyurethanes, nylon), or thermosetting particles (e.g., phenolic bubbles, phenolic beads, polyurethane foam particles).

Abrasive slurries of the present invention may further comprise suspending agents. An example of a suspending agent is an amorphous silica particle having a surface area less than 150 $m^2$/gram, commercially available from DeGussa Corp., under the trade designation "OX-50". The addition of the suspending agent may lower the overall viscosity of the abrasive slurry. The use of suspending agents is further described in U.S. Pat. No. 5,368,619, the disclosure of which is incorporated herein by reference.

Abrasive slurries of the present invention may further comprise grinding aids. Grinding aids interact beneficially at the workpiece/abrasive article interface during use of the abrasive article. In particular, it is believed that the grinding aid may either (1) decrease the friction between the abrasive particles and the workpiece being abraded, (2) prevent the abrasive particle from "capping" (i.e., prevent metal particles from becoming welded to the tops of the abrasive particles), (3) decrease the interface temperature between the abrasive particles and the workpiece, or (4) decrease the required grinding force. Grinding aids encompass a wide variety of different materials and can be inorganic or organic based. Examples of chemical groups of grinding aids useful in this invention include waxes, organic halide compounds, halide salts, metals, or metal alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, or magnesium chloride. Examples of metals include tin, lead, bismuth, cobalt, antimony, cadmium, iron, or titanium. Other grinding aids include sulfur, organic sulfur compounds, graphite, or metallic sulfides. It is also within the scope of this invention to use a combination of different grinding aids which may, in some instances, produce a synergistic effect. The grinding aids listed herein are a representative list only.

Grinding aids are preferably used in abrasive slurries of the present invention in amounts ranging from 0% to about 60% by weight, more preferably from 0% to about 40% by weight, based on the total weight of the abrasive slurry. If non-reactive fillers are employed, grinding aids may be used up to about 50% by weight.

Preparing an Abrasive Slurry

An abrasive slurry of the present invention may be prepared by combining together a binder precursor, abrasive particles, and optional ingredients, using any suitable mixing technique. Examples of mixing techniques include both low shear and high shear mixing, with high shear mixing being preferred. Ultrasonic energy may also be utilized in combination with the mixing step to lower the viscosity of the abrasive slurry. Typically, abrasive particles are gradually added to the binder precursor. It is preferred that the abrasive slurry be a homogeneous mixture of binder precursor, abrasive particles and optional additives. If necessary, water and/or solvent can be added to reduce the viscosity. In some instances it is preferred to heat the abrasive slurry to lower the viscosity.

It is important the abrasive slurry be monitored before coating to ensure a rheology that coats well and to ensure that the abrasive particles and other fillers do not settle before coating.

Abrasive Articles

The present invention provides not only abrasive slurries but also provides abrasive articles made from the abrasive slurries. Abrasive articles of the present invention may be coated abrasive articles or nonwoven abrasive articles.

Coated abrasive articles of the present invention comprise a backing having an abrasive coating adhered to the front surface thereof. The abrasive coating comprises an abrasive slurry of the present invention which has been cured or solidified. The abrasive coating may be provided as a continuous coating have any desired surface topography or, alternatively, may be provided as a plurality of composite particles adhered to the backing by a coating (i.e., make coating) or series of coatings.

Nonwoven abrasive articles comprise an open, lofty, three-dimensional web of fibers bound together at points of mutual contact by a binder. The binder of such a construction may comprise a slurry of the present invention. In addition, abrasive composite particles of the present invention may be adhered to the fibers of a nonwoven web to provide a nonwoven abrasive article. Methods of making nonwoven abrasive articles are described in U.S. Pat. No. 2,958,293 (Hoover) and U.S. Pat. No. 4,227,350 (Fitzer), the disclosures of which are incorporated herein by reference.

Figure 2:
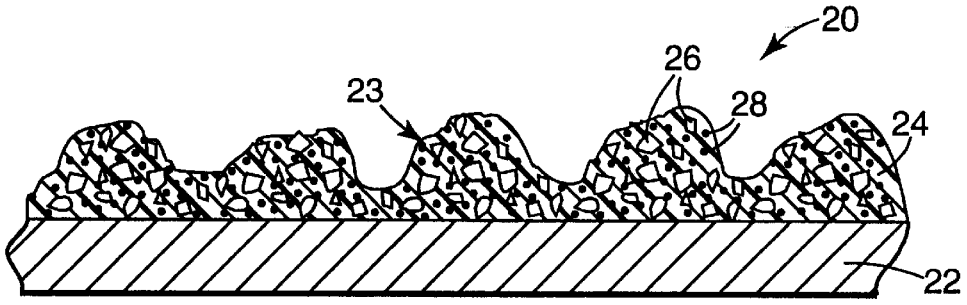
FIG. 2 is a side view in cross-section of a first embodiment of an abrasive article of the present invention.

Referring to FIG. 2, a first embodiment of an abrasive article according to the present invention is illustrated. Abrasive article 20 comprises backing 22 having on its front surface abrasive coating 23. Abrasive coating 23 comprises a plurality of abrasive particles dispersed in a binder 24. Abrasive coating 23 is formed by curing or solidifying an abrasive slurry of the present invention. In this embodiment, binder 24 bonds the abrasive coating 23 to backing 22. According to the present invention the abrasive particles comprise a mixture of at least two distinct grades of abrasive particles, a first larger grade 26, and a second smaller grade 28, which are dispersed throughout binder 24. In an abrasive article of the present invention, the median particle size ratio (i.e., median particle size of larger grade 26 divided by median particle size of smaller grade 28) is about 2 or greater. More preferably, the median particle size ratio is about 3 or greater. Most preferably the median particle size ratio is about 5 or greater, and particularly most preferably the median particle size ratio is about 7 or greater.

Abrasive coating 23 can have any desired surface topography. The surface topography of abrasive coating 23 can be controlled by factors such as, for example, the coating technique used to apply the abrasive slurry, the rheology of the abrasive slurry, and the time period between coating and cure or solidification of the abrasive slurry. In FIG. 2, abrasive coating 23 has a textured sinusoidal-like surface topography comprising a plurality of raised irregularly shaped, regularly repeating ridges. A sinusoidal-like surface topography may be formed, for example, by gravure coating an abrasive slurry of the present invention onto a backing. Alternatively, abrasive coating 23 may have a smooth surface topography, formed, for example, by knife coating or die coating an abrasive slurry of the present invention onto a backing.

Figure 3:
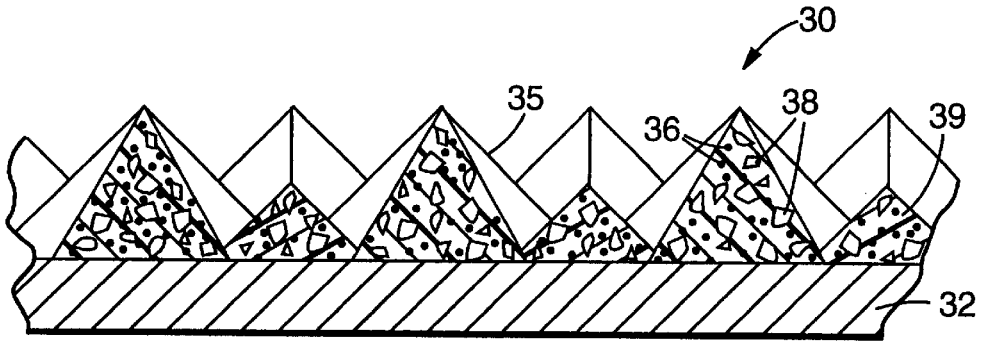
FIG. 3 is a side view in cross-section of a second embodiment of an abrasive article of the present invention.

Referring to now to FIG. 3, a second embodiment of an abrasive article of the present invention is shown is illustrated. Abrasive article 30 is a structured abrasive article comprising a plurality of precisely shaped abrasive composites each composite having a predetermined shape and being disposed on a backing in a predetermined array. Abrasive article 30 comprises a backing 32 having on its front surface a plurality of precisely shaped abrasive composites 35. Abrasive composites 35 have a discernible precise shape (i.e., pyramidal) and comprise a plurality of abrasive particles dispersed in a binder 39. In this embodiment, binder 39 bonds abrasive composites 35 to backing 32. The abrasive composites 35 are formed by curing or solidifying an abrasive slurry of the present invention. Therefore, the abrasive particles comprise at least two distinct grades of abrasive particles, a first larger grade 38, and a second smaller grade 36. In an abrasive article of the present invention, the median particle size ratio (i.e., median particle size of larger grade 38 divided by median particle size of smaller grade 36) is about 2 or greater. More preferably, the median particle size ratio is about 3 or greater. Most preferably the median particle size ratio is about 5 or greater, and particularly most preferably the median particle size ratio is about 7 or greater.

Structured abrasive articles may be produced by at least partially curing or solidifying an abrasive slurry of the present invention while the abrasive slurry is being held within precisely shaped recesses of a production tool. The precisely shaped recesses of the production tool function to mold the abrasive slurry to the desired precise shape. The binder precursor of the abrasive slurry must be at least partially cured or solidified while being held in the precisely shaped recesses so that that the abrasive slurry is set, and does not deform from its precise shape upon removal from the production tool.

Figure 4:
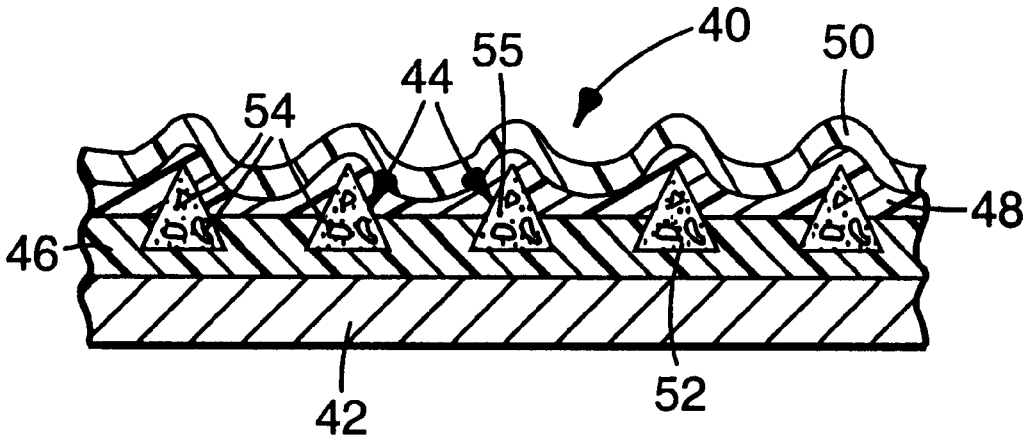
FIG. 4 is a side view in cross-section of a third embodiment of an abrasive article of the present invention.
Figure 5:
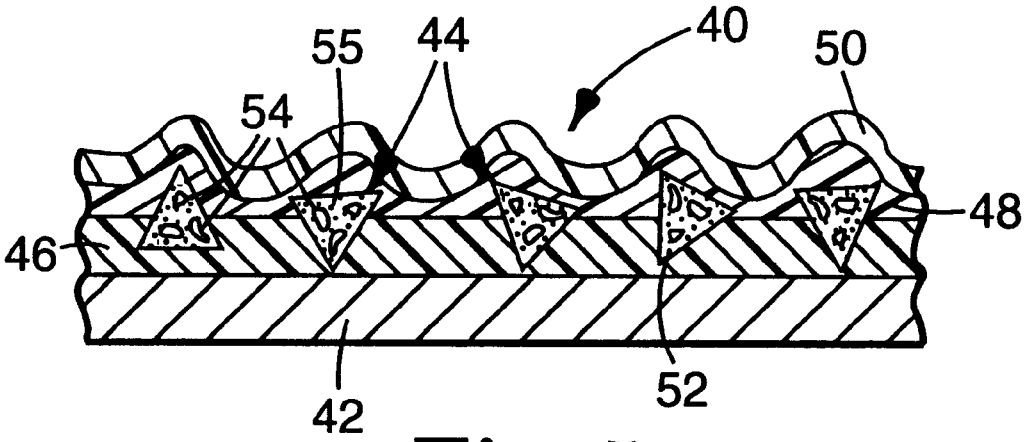
FIG. 5 is a side view in cross-section of a fourth embodiment of an abrasive article of the present invention.

Referring now to FIGS. 4 and 5, third and fourth embodiments of an abrasive article according to the present invention are shown. Abrasive article 40 comprises backing 42 having bonded thereto a plurality of composite particles 44. Composite particles 44 comprise a plurality of abrasive particles dispersed in a binder. The composite particles are formed by curing or solidifying an abrasive slurry of the present invention in the form of individual particles. Composite particles 44 comprise binder 52 having dispersed therein a mixture of at least two distinct grades of abrasive particles, a first larger grade 54, and a second smaller grade 55. The median particle size ratio (i.e., median particle size of larger grade 54 divided by median particle size of smaller grade 55) is about 2 or greater. More preferably, the median particle size ratio is about 3 or greater. Most preferably the median particle size ratio is about 5 or greater, and particularly most preferably the median particle size ratio is about 7 or greater. Composite particles 44 may be precisely shape or may be irregularly shaped. Precisely shaped composite particles may be formed by at least partially curing or solidifying an abrasive slurry of the present invention while the slurry is held within the precisely shaped recesses of a production tool. Irregularly shaped composite particles may be formed, for example, by crushing a cured or solidified abrasive slurry thereby forming individual irregularly shaped and sized composite particles. In this embodiment, precisely shaped composite particles 44 are bonded to backing 42 by two coatings. Coating 46, commonly referred to as a make coat, is applied over backing 42 and bonds composite particles 44 to backing 42. Coating 48, commonly referred to as a size coat, is applied over composite particles 44 and reinforces composite particles 44. Optionally, a third coating 50, commonly referred to as a supersize coat, may be applied over the size coat 48. The composite particles may be applied to the backing by conventional techniques, such as drop coating or electrostatic coating. Depending upon the coating method, the composite particles may be oriented with respect to the backing in a non-random manner (see FIG. 4), or they may be oriented in a random manner with respect to the backing (see FIG. 5).

Backing Materials for Abrasive Articles

The backing for an abrasive article according to the present invention may be any number of conventionally used backings, such as paper, cloth, film, vulcanized fiber, woven and nonwoven materials, and the like, or a combination of two or more of these materials, or treated versions thereof. The choice of backing material will depend on the intended application of the abrasive article. The strength of the backing should be sufficient to resist tearing or other damage during use, and the thickness and smoothness of the backing should allow achievement of the product thickness and smoothness desired for the intended application. The adhesion of the abrasive slurry to the backing should also be sufficient to prevent significant shedding of individual abrasive particles or the abrasive coating during normal use, known as "shelling". In some applications it is also preferable that the backing be waterproof. The thickness of the backing should be sufficient to provide the strength desired for the intended application; nevertheless, it should not be so thick as to affect the desired flexibility in the abrasive article. It is preferred that the backing be a polymeric film, such as polyester film for fine finishing coated abrasives, and that the film be primed with a material, such as ethylene acrylic acid copolymer, to promote adhesion of the abrasive slurry and resulting abrasive composite to the film. In some instances it may be preferred that the backing be transparent to ultraviolet or visible radiation.

In the case of a woven backing, it is sometimes preferable to fill the interstices of the backing with at least one coating before the application of an abrasive slurry. Coatings used for this purpose are called saturant, back or presize coatings, depending on how and to what surface of the backing the coating is applied.

The backing may comprise a laminate of backings made by laminating two or more plies of either similar or dissimilar backing materials. For example, a film can be laminated to a stiffer, more rigid substrate, such as a metal plate, to produce an abrasive article having an abrasive coating supported on a rigid substrate.

The back surface of the backing may also contain a pressure-sensitive adhesive or a hook and loop type attachment system so that the abrasive article can be secured to a back-up pad. Examples of pressure-sensitive adhesives suitable for this purpose include rubber-based adhesives, acrylate-based adhesives, and silicone-based adhesives. Hook and loop type attachment systems are reported, for example, in U.S. Pat. No. 5,505,747 (Chesley et al.).

Method of Making Abrasive Articles and Structured Abrasive Articles

The present invention further provides representative methods for making abrasive articles of the present invention. A first method of making an abrasive article is provided which comprises the steps of:

(a) coating a backing with an abrasive slurry of the present invention; and (b) subjecting the abrasive slurry to conditions sufficient to at least partially cure the binder precursor.

An abrasive slurry may be coated onto the front surface of a backing by any conventional coating method, such as, for example, roll coating, transfer coating, spraying, die coating, curtain coating, knife coating, and rotogravure coating. The abrasive coating may be have any desired surface topography. For example, the surface may be smooth, textured, or structured. The surface topography may be controlled by the coating technique used to coat the abrasive slurry (i.e., a sinusoidal-like topography may be provided by a rotogravure cylinder), or the surface topography may be produced by a separate texturing process.

Once coated, the binder precursor of the abrasive slurry is typically exposed to an energy source in order to convert the binder precursor to a binder. Conversion of the binder precursor to the binder is typically the result of a polymerization, crosslinking, gelling, or drying process. The energy source may be a source of thermal energy, or radiation energy, such as, electron beam, ultraviolet light, or visible light. The total amount of energy required to convert the binder precursor into a binder is dependent upon the chemical structure of the of binder precursor, and the thickness and optical density of the abrasive slurry. When thermal energy is used, the oven temperature will typically range from about 50° C. to about 250° C., and the exposure time will typically range from about 15 minutes to about 16 hours. For binder precursors solidified by free radical polymerization, the UV or visible radiation energy level (in the absence of heating) should be at least about 100 milliJoules/cm$^2$, more preferably from about 100 to about 700 milliJoules/cm$^2$, and particularly preferably from about 400 to about 600 milliJoules/cm$^2$. Ultraviolet radiation refers to electromagnetic radiation having a wavelength in the range of about 200 to about 400 nanometers, preferably within the range of about 250 to 400 nanometers. Visible radiation refers to electromagnetic radiation having a wavelength in the range of about 400 to about 800 nanometers, and preferably in the range of about 400 to about 550 nanometers.

Electron beam irradiation, a form of ionizing radiation, can be used at an energy level of about 0.1 to about 10 Mrad, preferably at an energy level of about 1 to about 10 Mrad, at accelerating potential ranging from about 150 to about 300 kiloelectron volts.

The abrasive coating typically comprises by weight from about 1 to about 90 parts abrasive particles and from about 10 to about 99 parts binder. Preferably, the abrasive coating comprises about 30 to about 85 parts abrasive particles and about 15 to about 70 parts binder. More preferably the abrasive coating comprises about 40 to about 70 parts abrasive particles and about 30 to about 60 parts binder.

A preferred method of making an abrasive article of the present invention is provided which comprises the steps of:

(a) providing a production tool having a major surface said major surface having a plurality of precisely shaped recesses formed therein;

(b) filling said precisely shaped recesses with an abrasive slurry of the present invention;

(c) providing a backing having a front and a back surface;

(d) laminating the front surface of a backing to the surface of the production tool so that at least a portion of the front surface of the backing is in direct contact with the surface of the production tool;

(e) subjecting the abrasive slurry to conditions sufficient to at least partially cure the binder precursor; and (f) separating the backing from the production tool.

The production tool of step (a) has a surface (defining a main plane) which contains a plurality of recesses distending as indentations from the main plane. These recesses define the inverse shape of the abrasive composite and are responsible for generating the shape and placement of the abrasive composites. The recesses can be provided in any geometric shape that is the inverse of a geometric shape which is suitable for an abrasive composite, such as, for example, cubic, cylindrical, prismatic, hemispheric, rectangular, pyramidal, truncated pyramidal, conical, truncated conical, or post-like with a flat top surface. The dimensions of the recesses are selected to achieve the desired areal density of abrasive composites. Preferably, the shape of the recesses is selected such that the surface area of the abrasive composite decreases away from the backing. The recesses can be present in a dot like pattern where adjacent cavities butt up against one another.

The production tool can take the form of a belt, sheet, continuous sheet or web, coating roll such as a rotogravure roll, sleeve mounted on a coating roll, or die. The production tool can be composed of metal, (e.g., nickel), metal alloys, or thermoplastic material. The metal production tool can be fabricated by any conventional technique including but not limited to photolithography, knurling, engraving, hobbing, electroforming, or diamond turning.

A production tool made of thermoplastic material may be replicated from a master tool. When a production tool is replicated from a master tool, the master tool is provided with the inverse of the pattern which is desired for the production tool. The master tool is preferably made of a nickel-plated metal, such as nickel-plated aluminum, nickel-plated copper, or nickel-plated bronze. A production tool can be replicated from a master tool by pressing a sheet of thermoplastic material against the master tool while heating the master tool and/or the thermoplastic sheet such that the thermoplastic material is embossed with the master tool pattern. Alternatively, the thermoplastic material can be extruded or cast directly onto the master tool. The thermoplastic material is then cooled to a solid state and is then separated from the master tool to produce a production tool. The production tool may optionally contain a release coating to permit easier release of the abrasive article. Examples of such release coatings include silicones and fluorochemicals.

Preferred methods for the production of production tools are disclosed in U.S. Pat. Nos. 5,435,816 (Spurgeon et al.), 5,658,184 (Hoopman et al.), and in U.S. Ser. No. 08/923,862 (Hoopman) filed Sep. 3, 1997, the disclosures of which are incorporated herein by reference.

In one aspect of this method, an abrasive slurry is first coated directly onto the front surface of a backing using any conventional coating technique such as, for example, roll coating, transfer coating, spraying, die coating, vacuum die coating, knife coating, curtain coating, and rotogravure coating. The production tool is then brought into contact with the abrasive slurry coated backing such that the abrasive slurry flows into the recesses of the production tool. Pressure may be applied by a nip roll or other suitable technique in order to force the abrasive slurry to flow in and fill the recesses of the production tool.

In a preferred aspect of this method, the recesses are filled by coating the abrasive slurry directly onto the production tool. This can be accomplished by any conventional coating method such as, for example, roll coating, transfer coating, spraying, die coating, vacuum die coating, knife coating, curtain coating, or rotogravure coating. The backing is then brought into contact with the outer surface of the production tool such that the abrasive slurry-coated production tool wets the surface of the backing. Pressure may be applied by a nip roll or other suitable technique in order to force the abrasive coating against the backing to improve adhesion between the abrasive slurry and the backing.

Next, the binder precursor is at least partially cured or solidified. This can be accomplished by exposing the abrasive slurry to an energy source. The energy source may be heat, radiation energy (i.e., infrared or visible radiation), or electron beam. Preferably the energy source is radiation energy. If the production tool is made from a material transparent to visible or ultraviolet radiation (e.g., polypropylene or polyethylene thermoplastic) then visible or ultraviolet light may be transmitted through the production tool to cure or solidify the binder precursor. In this step, the resulting solidified abrasive slurry or abrasive composites will have the inverse pattern of the production tool. Following cure or solidification of the binder precursor (i.e., formation of a binder), the backing containing having the abrasive coating bonded thereto is separated from the production tool.

In a variation of the method, the slurry-coated backing may be separated from the production tool prior to curing or solidifying the binder precursor. Separation from the production tool may distort the surface topography of the abrasive slurry thereby forming a surface topography which is irregular and does not match the precisely shaped recesses in the production tool. Further, after separation from the production tool, the abrasive slurry may flow so as to produce an irregular surface topography. The surface topography of the slurry resulting from this method may depend upon a variety of factors, such as, for example, the rheological properties of the abrasive slurry, the shape of the precisely shaped recesses in the production tool, the rate of separation of the backing from the production tool, the type of backing, the type and grade of abrasive particles in the abrasive slurry, the temperature of the abrasive slurry and production tool, or the time interval between separation of the backing and conversion of the binder precursor to a binder. Once separated from the production tool, the abrasive slurry is then cured or solidified.

Method of Making Abrasive Articles with Composite Particles

According to the present invention, abrasive articles may be produced by first producing abrasive composite particles, and then bonding the abrasive composite particles to the front surface of a backing with a coating (i.e., a make coating), or series of coatings (i.e., a make coat and size coat). Composite particles are distinct, free-flowing, individual particles comprising a cured or solidified abrasive slurry of the present invention. Composite particles may be formed in any desired shape and/or size and may be precisely-shaped or irregularly shaped.

Figure 6:
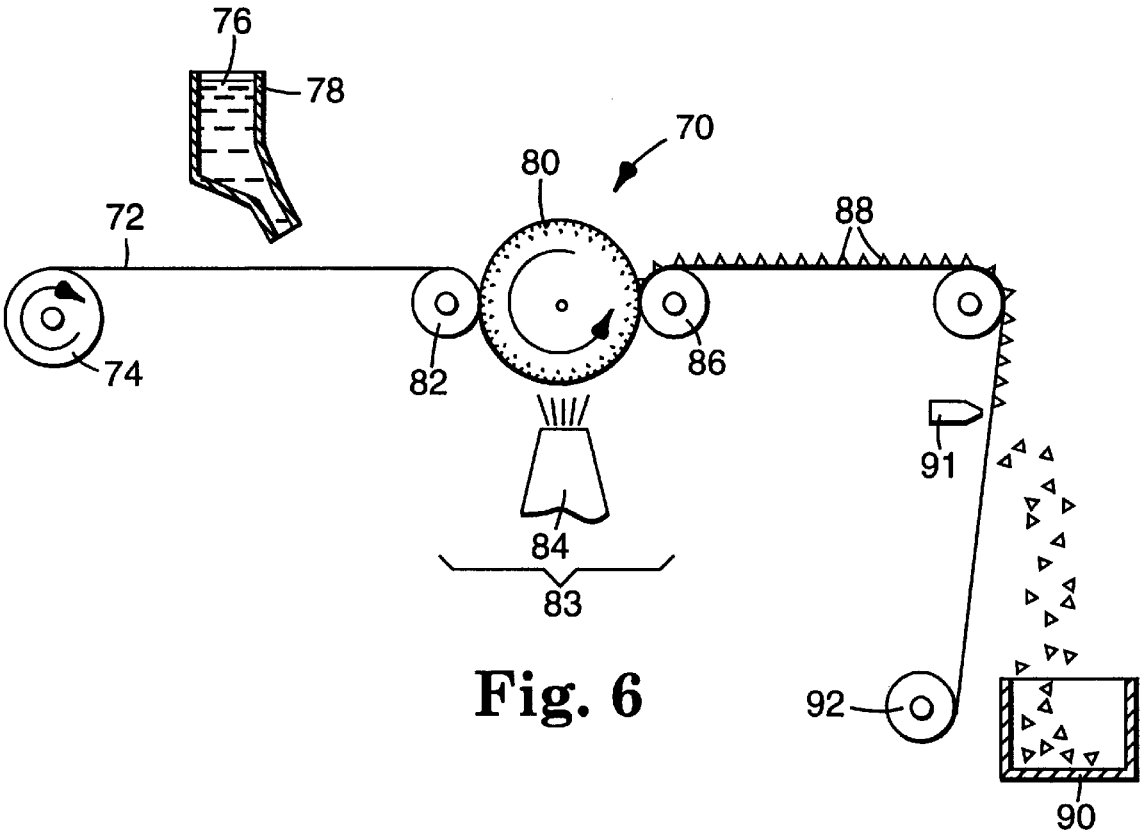
FIG. 6 is a schematic of a process for making precisely shaped composite particles.

A typical manufacturing process for producing precisely shaped abrasive composite particles using an abrasive slurry of the present invention is illustrated in FIG. 6. Apparatus 70 comprises a carrier web 72 which is fed from an unwind station 74. Unwind station 74 is in the form of a roll. The carrier web 72 can be made of a material such as paper, cloth, polymeric film, nonwoven web, vulcanized fiber, combinations thereof, or treated versions thereof. The preferred material for the carrier web 72 is a polymeric film, such as, for example, a polyester film. In FIG. 6, the carrier web 72 is transparent to radiation. An abrasive slurry of the present invention 76 is fed by gravity from a hopper 78 onto a major surface of the carrier web 72. The major surface of the carrier web 72 containing the abrasive slurry 76 is forced against the surface of a production tool 80 by means of a nip roll 82. The surface of the production tool 80 that contacts the carrier web contains precisely shaped recesses. The precisely shaped recesses shape or mold the precisely shaped composite particles. The nip roll 82 also aids in forcing the abrasive slurry 76 into the recesses of the production tool 80. The abrasive slurry 76 then travels through a curing zone 83 where it is exposed to an energy source 84 to at least partially cure or solidify the binder precursor to form a binder. Next, the carrier web 72 containing the solidified binder is passed over a nip roll 86. There must be sufficient adhesion between the carrier web 72 and the solidified binder in order to allow for subsequent removal of the binder from the cavities of the production tool 80. The composite particles are removed from the carrier web 72 and collected in a container 90. External means 91 (e.g., ultrasonic energy) can be used to help release the composite particles 88 from the carrier web 72. The carrier web 72 is then recovered at rewind station 92 so that it can be reused. Rewind station 92 is in the form of a roll.

Precisely shaped composite particles may also be produced, for example, by extruding an abrasive slurry of the present invention through a precisely shaped orifice or die (i.e., a triangular die), cutting the particle to length, and curing or solidifying the binder precursor. This technique may be suitable for manufacturing precisely shaped composite particles having a constant cross sectional shape.

Other methods for the production of precisely shaped abrasive composite particles are reported in U.S. Pat. No. 5,500,273 (Holmes et al.).

It is preferred that the size of the precisely shaped abrasive composite particles range from about 0.1 to about 1500 micrometers, more preferably from about 0.1 to about 1000 micrometers. As indicated previously, the precise shape corresponds to portions of the surface of the production tool, e.g., recesses formed in the surface of the production tool. The precise shape is attributable to the binder precursor's being at least partially cured or solidified in the recesses of the production tool. There may, however, be minor imperfections in the particles that are introduced when the particles are removed from the cavities. The precise shape can be any geometrical shape, such as, for example, a cone, triangular prism, cylinder, pyramid, hemisphere, and a body having two opposed polygonal faces separated by a constant or varying distance(i.e., a polygonal platelet). Pyramids preferably have bases having three or four sides. The abrasive article may contain a variety of abrasive particles having different shapes.

It is also within the scope of this invention to produce irregularly shaped composite particles. If, for example, the binder precursor is not sufficiently cured or solidified (i.e., not set) in the recesses of the production tool, the binder precursor will flow after the composite particles are removed. The shape of the resulting composite particles will therefore not correspond to the shape of the recesses. The degree to which the particles will flow or distort from their initial precise shape may depend upon such factors as, for example, the rheology of the abrasive slurry, the degree of cure, the time period between removal from the recesses and final cure or solidification of the binder precursor. Irregularly shaped composite particles may also be produced by first curing or solidifying an abrasive slurry of the present invention and then crushing the cured slurry to form individual irregularly shaped composite particles. The particles may be size graded to meet industry standards such as ANSI standards.

An abrasive article utilizing composite particles may be made according to the following procedure. A backing having a front surface and a back surface is provided. The front surface of the backing is coated with a first curable coating, commonly referred to as a make coat. The composite particles are then coated or applied to the first curable coating. The composite particles can be drop coated or electrostatic coated. Alternatively, the composite particles can be oriented on the backing in a specified direction. In the case of precisely shaped abrasive composite particles having the shapes of pyramids, cones, and prisms (e.g., triangular-shaped prisms), the particles can be oriented so that their bases point toward the backing and their vertexes point away from the backing, as in FIG. 4, or they can be oriented so that their vertexes point toward the backing and their bases point away from the backing, as illustrated in FIG. 5. With respect to pyramids and cones, the vertex referred to is the common vertex. The first curable coating is then solidified or cured to adhere the particles to the backing. Optionally, a second curable coating can be applied over the composite particles and then solidified or cured to form a size coat. The second curable coating can be applied prior to or subsequent to solidification or curing of the first curable coating. The size coat further bonds the abrasive particles to the backing. Optionally, additional coatings, such as a supersize coat can be applied over the composite particles and size coat.

The first and second curable coatings (i.e., make coat and size coat) comprise a curable resin and optional additives. Examples of resins suitable for this invention include phenolic resins, aminoplast resins, urethane resins, epoxy resins, acrylate resins, acrylated isocyanurate resins, urea-formaldehyde resins, isocyanurate resins, acrylated urethane resins, vinyl ethers, acrylated epoxy resins, and combinations thereof. Optional additives include fillers, fibers, lubricants, wetting agents, surfactants, pigments, dyes, coupling agents, plasticizers, or suspending agents. Examples of fillers include talc, calcium carbonate, calcium metasilicate, silica, or combinations thereof. The amounts of these materials are selected to provide the properties desired. The make coat and size coat may be the same formulation or a different formulation.

The following non-limiting examples will further illustrate the invention. All parts, percentages, ratios, etc., in the examples are by weight unless otherwise indicated. The following abbreviations and trade designations are used throughout:

| | |
|---|---|
| AO | fused aluminum oxide abrasive particles; |
| ASF | amorphous silica filler, commercially available from DeGussa Corp. under the trade designation "OX-50"; |
| BSiC | black silicon carbide abrasive particles; |
| CAO | iron oxide nucleated sol gel alumina abrasive particles, consisting of approximately 94.4% alpha alumina, 1.1% iron oxide, and 4.5% MgO; |
| FAZ | fused alumina-zirconia abrasive particles; |
| GSiC | green silicon carbide abrasive particles; |
| KBF4 | potassium tetrafluoroborate; |
| PH2 | 2-benzyl-2-N,N-dimethylamino-1-(4-morpholinophenyl)-1-butanone, commercially available from Ciba Geigy Corp. under the trade designation "IRGACURE 369"; |
| PH3 | phosphine oxide, phenyl bis (2,4,6-trimethyl benzoyl), commercially available from Ciba Geigy Corp. under the trade designation "IGRACURE 819"; |
| PRO | a mixture of 70/30 TMPTA/TATHEIC with 1% PH2; |
| SCA | silane coupling agent, 3-methacryloxypropyl-trimethoxysilane, commercially available from Union Carbide under the trade designation "A-174"; |
| TATHEIC | triacrylate of tris(hydroxy ethyl)isocyanurate, commercially available from Sartomer Co., under the trade designation "SR368"; |
| TMPTA | trimethylol propane triacrylate, commercially available from Sartomer under the trade designation "SR351". |

The abrasive articles produced and used in the examples below were made according to one of the procedures for preparing abrasive articles described below, and the abrasive articles were tested according to the test procedures described below.

General Procedure for Preparing Structured Abrasive Articles

The following general procedure was used to make the structured abrasive articles reported in Examples 1–16 and Comparative Example A. A production tooling have precisely shaped recesses therein was used to make the abrasive composites. Each composite was generally the inverse shape of the recess. Each composite was a 4 sided pyramid 533 micrometers (21 mil) high with 1371 micrometer (54 mil) long bases. The tool was produced by a knurling process according to the teachings of PCT publication WO 97/12727 (Hoopman et al.), incorporated herein by reference.

First, an abrasive slurry, comprising a binder precursor, was prepared by thoroughly mixing the raw materials as listed in a high shear mixer. The abrasive slurry was coated directly onto an X-weight polycotton cloth backing (having a latex/phenolic backing treatment) at a speed of about 15 meters/ minute (50 ft/min) with a knife coater using a gap between 430–557 micrometers (17–22 mils)

Next, the production tooling was pressed against the slurry with the force of a rubber nip roll so that the slurry filled the recesses of the production tool. UV/visible radiation, at a dosage of about 236 Watts/cm (600 Watts/inch) produced by 1 "D" bulb available from Fusion Systems, was transmitted through the tooling and into the abrasive slurry. The UV/visible radiation initiated the polymerization of the binder precursor and resulted in the abrasive slurry forming abrasive composites which were adhered to the cloth substrate. The coated abrasive product was post cured 12 hours at 115° C. (240° F.) to cure the backing treatment.

General Procedure for Preparing Precisely Shaped Composite Particles and an Abrasive Article The following general procedure, particularly described in U.S. Pat. No. 5,500,273, (Holmes et al.), was used to make the precisely shaped composite particles reported in Examples 17 and 18.

The production tool and the process to make the tool are described in U.S. Pat. No. 5,435,816 (Spurgeon et al.) and PCT publication WO 97/12727 (Hoopman et al.), both incorporated herein by reference. The precisely shaped composite particles were 762 micrometer (30 mil) high, four sided pyramids made in a production tool which was formed using the knurling teachings of WO 97/12727.

First, an abrasive slurry, comprising a binder precursor, was prepared by thoroughly mixing the raw materials in a high shear mixer. The abrasive slurry was coated onto a 130 micrometer (5 mil) thick polyester film primed with an ethylene acrylic acid copolymer using a knife coater with a 533 micrometer gap operating at a speed of about 15.24 meters/ minute (50 ft/min). Next, the production tool was pressed against the slurry by means of a roller so that the abrasive slurry filled the recesses of the production tool. UV/visible radiation, at a dosage of about 236 Watts/cm (600 Watts/inch) produced by 2 "D" bulbs, available from Fusion Systems, was transmitted through the tooling and into the abrasive slurry. The UV/visible radiation initiated the polymerization of the binder precursor and resulted in the abrasive slurry forming precisely shaped composite particles which were adhered to the film substrate.

Finally, the abrasive particle construction was separated from the production tool, and the precisely shaped composite particles were removed from the film backing by an ultrasonic horn (oscillated at a frequency of 19,100 Hz and at an amplitude of about 130 micrometers) so that individual free flowing particles were obtained. Any particles which were not individual were passed through a rubber roller to break up any attached composite particles.

Strips of coated abrasive articles were prepared using the following general procedure. A conventional calcium carbonate filled phenolic resin make coat was applied with a die coater at a weight of approximately 0.0266 g/cm$^2$ (2.75 g/16 in$^2$) onto a 350 g/m$^2$ phenolic/latex treated polyester/cotton cloth backing. Next, the precisely shaped composite particles were drop coated onto the make coat at a weight of approximately 0.0774 g/cm$^2$ (8 g/16 in$^2$) to produce a closed coat. Phenolic resin was applied over the particles with a paint brush to provide a size coat. The approximate weight of the size coat is reported in each example. The coated abrasive belts were heated in a convection oven at 93° C. (200° F.) for 90 minutes, and then at 110° C. (230° F.) for 10 hours.

The coated abrasive articles were tested using a rocking drum test. A 6 cm×23 cm strip of abrasive article was placed on a drum having a 30.5 cm (12 inch) diameter and either a 3.63 kg (8 lbs) or 4.54 kg (10 lbs) force pressed a 0.476 cm×0.476 cm×15.24 cm (3/16 inch×3/16 inch×6 inch) 1018 mild steel workpiece onto and against the abrasive article. The abrasive article was oscillated for 1000 cycles at a rate of one cycle per second over a total distance of 25 cm (10 inches) per cycle. The metal removed from the workpiece was measured and the results are reported in Table 3 for each pass (1 pass=1000 cycles).

EXAMPLES 1–7 AND COMPARATIVE EXAMPLES A & B

Examples 1–7 were structured abrasive articles of the present invention. Examples 1–7 were prepared by mixing 24.64 parts PRO, 0.85 part SCA, 0.85 part ASF, 31.16 parts KBF4 and 42.5 parts BSiC (FEPA Grade P-100, having a median particle size or $D_{50}$ of approximately 243 micrometers) and AO (ANSI Grade 320, having a median particle size or $D_{50}$ of approximately 45 micrometers) mixed as shown in Table 1. Examples 1–7 were processed as described in General Procedure I.

Comparative Example A was a structured abrasive belt commercially available from Minnesota Mining and Manufacturing Co., (St. Paul, Minn.), herein after referred to as "3M", under the trade designation "TRIZACT 407EA A110". This abrasive article consisted of 42.5 parts GSiC (FEPA Grade P-180, having a median particle size or $D_{50}$ of approximately 110 micrometers) and 24.64 parts PRO, 0.85 part SCA, 0.85 part ASF, and 31.16 parts KBF4.

Comparative Example B was a conventional coated abrasive belt commercially available from 3M under the trade designation "Regalloy". The abrasive particles in this belt were CAO, FEPA Grade P-80 having a median particle size or $D_{50}$ of approximately 260 micrometers.

The coated abrasive articles were tested using a rocking drum test. A 6 cm×23 cm strip of abrasive article was placed on a drum having a 30.5 cm (12 inch) diameter and 4.54 kg (10 lbs) force pressed a 0.476 cm×0.476 cm×15.24 cm (3/16 inch×3/16 inch×6 inch) 1018 mild steel workpiece onto and against the abrasive article. The abrasive article was oscillated for 300 cycles at a rate of one cycle per second over a total distance of 25 cm (10 inches) per cycle. The amount of thickness lost by the abrasive composites was measured with a micrometer and the results are reported in Table 1; the thickness of the abrasive article was measured in 4 places before testing and then again after the 300 cycles and the difference was calculated.

The coated abrasive articles were further tested using an offhand test. The abrasive article was converted to a 7.6 cm×335 cm (3×132 inch) endless belt and tested on a constant load surface grinder. A stainless steel golf club head was mounted in a holder. The belt was mounted over a contact wheel (Matchless Diamond Cross Cut Type A, 7.6 cm by 35.5 cm) and was rotated at about 2285 meters per minute. The golf club head was ground while manually being held by the operator. No lubricant was used.

TABLE 1

Results of amount of mineral in blend on breakdown.

| Example | BSiC | AO | Caliper loss | Offhand Test Results |
|---|---|---|---|---|
| 1 | 50% | 50% | not measured | good cut and excellent finish |
| 2 | 40% | 60% | 287 micrometers (11.4 mils) | some capping*; very slow breakdown of composite |
| 3 | 50% | 50% | 249 micrometers (9.8 mils) | good performance |
| 4 | 60% | 40% | 282 micrometers (11.1 mils) | much faster cut than Example 2 |
| 5 | 70% | 30% | 231 micrometers (9.1 mils) | faster cut than Example 2 |
| 6 | 80% | 20% | 267 micrometers (10.5 mils) | not tested |
| 7 | 90% | 10% | 363 micrometers (14.3 mils) | wore down to backing much too fast |
| Comp. A | 100% GSiC | 0 | wore completely down to backing | wore down to backing; less life and similar in finish to Example 4. |
| Comp. B | 0% | 50% (50% CAO) | not measured | good cut rate coarse finish |

*"Capping" occurs when the belt is glazed with metal particles and residue from the workpiece. Generally the belt stop cutting (i.e., removing stock) and starts to polish (i.e., surface refinement but no stock removal).

The results in Table 1 indicate that the offhand grinding performance was affected by the ratio of the abrasive particles. Example 1 provided a finer finish than Comparative Example A with a similar cut rate, even though the mineral size of Example 1 was larger than the mineral size in Comparative Example A. When the smaller particle size was greater than 50% of the total abrasive particles the product was very hard to breakdown and did not cut well (i.e., it glazed over), When the larger particle size mineral was present at 90% or more the coated abrasive has very poor life and broke down very rapidly.

Example 4 was further used to remove titanium weld seams on the soles of titanium golf club heads. It was unexpected that Example 4 of the present invention provided surface finishes similar to Comparative Example A which had abrasive particles several grades finer, and had comparable cut rate and equivalent life to Comparative Example B which had a slightly coarser abrasive particles.

EXAMPLES 8–16

Examples 8–16 were structured abrasive articles made according to the present invention. Examples 8–16 were prepared by mixing 23.32 parts PRO, 0.81 part SCA, 0.81 part ASF, 34.95 parts KBF4 and 40.21 parts abrasive particles as shown in Table 2. Examples 8–16 were processed as described in General Procedure I.

The abrasive articles were tested on the rocking drum and offhand tests and the results are reported in Table 2.

For Examples 8, 9, and 10, the BSiC was a FEPA Grade P-80 having a median particle size, or $D_{50}$, of approximately 260 micrometers. For Examples 11 through 16, both the CAO and AO was a FEPA Grade P-100 having a median particle size, or $D_{50}$, of approximately 243 micrometers. For Examples 8, and 11–16 the AO was a FEPA Grade F-320 having a median particle size, or $D_{50}$, of approximately 45 micrometers. For Example 9, the AO was a FEPA Grade F-240 having a median particle size, or $D_{50}$, of approximately 65 micrometers, and for Example 10 the AO was a FEPA Grade F-220 having a median particle size, or $D_{50}$, of approximately 80 micrometers.

TABLE 2

| Example | Abrasive Particles | Abrasive Particles | Offhand Test Results |
|---|---|---|---|
| 8 | 50% P-80 BSiC | 50% F320 AO | not tested |
| 9 | 50% P-80 BSiC | 50% F240 AO | not tested |
| 10 | 50% P-80 BSiC | 50% F220 AO | Best cut rate and life of Examples 8–10 |
| 11 | 40% P100 CAO | 60% F320 AO | average cut rate when compared to Comp. Ex. B |
| 12 | 50% P100 CAO | 50% F320 AO | better cut rate than Example 11 |
| 13 | 60% P100 CAO | 40% F320 AO | Best cut rate of Examples 11–13 |
| 14 | 40% P-100 AO | 60% F320 AO | fair cut rate |
| 15 | 50% P-100 AO | 50% F320 AO | better cut rate than Example 14 |
| 16 | 60% P-100 AO | 40% F320 AO | Best cut rate of 14–16 |

The results in Table 2 indicate that other minerals can be used with this invention. Also, when the size of the large mineral is increased the size of the smaller mineral needs to be increased also. Again, the grinding performance is best when the percentage of larger mineral size is greater than the smaller mineral size.

EXAMPLES 17 AND 18

Examples 17 and 18 were abrasive articles comprising precisely shaped composite particles, wherein the composite particles were made according to the present invention. The composite particles of Examples 17 and 18 were prepared by mixing 0.8 parts ASF, 0.8 parts SCA, 35.1 parts KBF4, 0.2 parts PH2, 17.3 parts TMPTA, and 7.4 parts TATHEIC, 0.2 parts PH3, 19.1 parts BSiC, and 19.1 parts FAZ. For Example 17, the BSiC was a FEPA P-80 (having a median particle size or $D_{50}$ of approximately 200 micrometers) and the FAZ was a FEPA P-240 (having a median particle size or $D_{50}$ of approximately 65 micrometers). For Example 18, the BSiC was a FEPA P-60 (having a median particle size or $D_{50}$ of approximately 260 micrometers) and the FAZ was a FEPA P-180 (having a median particle size or $D_{50}$ of approximately 100 micrometers).

Examples 17 and 18 were tested on the rocking drum test and the loss of weight by the workpiece was measured every 1000 cyclcs (1 pass=1000 cycles). The results are reported in Table 3.

TABLE 3

| Example<br>Force (kg) | 17<br>3.63 | 17<br>4.54 | 18<br>3.63 | 18<br>4.54 |
|---|---|---|---|---|
| 1st pass (grams) | 0.14 | 0.14 | 0.33 | 0.37 |
| 2nd pass (grams) | 0.11 | 0.15 | 0.29 | 0.32 |
| 3rd pass (grams) | 0.12 | 0.12 | 0.25 | 0.22 |
| 4th pass (grams) | 0.07 | 0.13 | 0.18 | 0.15 |
| 5th pass (grams) | 0.05 | 0.12 | 0.13 | 0.12 |
| 6th pass (grams) | 0.05 | 0.15 | 0.12 | 0.10 |
| 7th pass (grams) | 0.03 | 0.11 | 0.06 | 0.04 |
| 8th pass (grams) | — | 0.08 | 0.04 | 0.02 |
| 9th pass (grams) | — | 0.03 | — | 0.01 |
| Total Cut (grams) | 0.57 | 1.03 | 1.4 | 1.35 |

What is claimed is:

1. An abrasive article comprising:

a backing having a front and a back surface;

an abrasive coating bonded to the front surface of the backing said abrasive coating comprising:

a binder;

a plurality of abrasive particles having a Mohs' hardness of 7 or greater dispersed in said binder, said plurality of abrasive particles comprising at least:

a first grade of abrasive particles having a first median particle size; and a second grade of abrasive particles having a second median particle size;

wherein the abrasive particles have a median particle size of from about 1 to 250 micrometers and the median particle size ratio is about 2 or greater.

2. An abrasive article according to claim 1 wherein said plurality of abrasive particles have a Mohs' hardness of 8 or greater.

3. An abrasive article according to claim 1 wherein said plurality of abrasive particles have a Mohs' hardness of 8.5 or greater.

4. An abrasive article according to claim 2 wherein the median particle size ratio is about 3 or greater.

5. An abrasive article according to claim 2 wherein the median particle size ratio is about 5 or greater.

6. An abrasive article according to claim 2 wherein the median particle size ratio is about 7 or greater.

7. An abrasive article according to claim 1 wherein said abrasive coating is provided as a textured coating.

8. An abrasive article according to claim 1 wherein said abrasive coating is provided as a smooth coating.

9. An abrasive article according to claim 1 wherein said abrasive coating is provided as a structured abrasive coating comprising an array of precisely shaped abrasive composites each composite comprising said plurality of abrasive particles dispersed in a binder.

10. An abrasive article according to claim 9 wherein said array is random.

11. An abrasive article according to claim 9 wherein said array is non-random.

12. An abrasive article according to claim 1 wherein said abrasive coating is provided as a plurality of composite particles adhered to said backing by a make coat, each composite particle comprising said plurality of abrasive particle dispersed in a binder.

13. An abrasive article according to claim 12 wherein said composite particles are precisely shaped.

14. An abrasive article according to claim 12 wherein said abrasive coating is adhered to said backing by a make coat and a size coat.

15. An abrasive article according to claim 12 wherein said make coat is selected from the group consisting of phenolic resins, aminoplast resins, urethane resins, epoxy resins, acrylate resins, acrylated isocyanurate resins, urea-formaldehyde resins, isocyanurate resins, acrylated urethane resins, vinyl ether resins, acrylated epoxy resins, and mixtures thereof.

16. An abrasive article according to claim 13 wherein said precisely shaped composite particles are cones, triangular prisms, cylinders, pyramids, hemispheres, polygonal platelets, or mixtures thereof.

17. An abrasive article according to claim 12 wherein said median particle size ratio is about 5 or greater.

18. An abrasive article according to claim 2 wherein said binder is addition polymerizable.

19. An abrasive article according to claim 2 wherein said binder is selected from the group consisting of phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, and mixtures thereof.

20. An abrasive article according to claim 2 wherein said abrasive particles are selected from the group of abrasive particles consisting of boron carbide, cubic boron nitride, fused aluminum oxide, ceramic aluminum oxide, heat treated aluminum oxide, alumina zirconia, silicon carbide, iron oxides, tantalum carbide, cerium oxide, garnet, titanium carbide, synthetic and natural diamond, zirconium oxide, silicon nitride, and mixtures thereof.

21. An abrasive article according to claim 2 wherein said first abrasive particles and said second abrasive particles comprise different abrasive materials.

22. An abrasive article according to claim 2 wherein said first abrasive particles and said second abrasive particles comprise the same abrasive material.

23. An abrasive article according to claim 2 wherein said plurality of abrasive particles comprises from about 25% to about 75% by weight of said first abrasive particles and from about 25% to about 75% by weight of said second abrasive particles.

24. An abrasive article according to claim 2 wherein said plurality of abrasive particles comprises about 60% by weight of said first abrasive particles and about 40% by weight of said second abrasive particles.

25. An abrasive article according to claim 2 wherein said first abrasive particles have a size in the range from about 100 to about 250 micrometers and said second abrasive particles have a size in the range from about 1 to about 80 micrometers.

26. A method of making an abrasive article comprising the steps of:

(a) coating a backing with an abrasive slurry said abrasive slurry comprising:
- a binder precursor;
- a plurality of abrasive particles having a Mohs' hardness of 7 or greater randomly dispersed in said binder precursor, said plurality of abrasive particles comprising at least:
  - a first grade of abrasive particles having a first median particle size; and
  - a second grade of abrasive particles having a second median particle size;
- wherein the abrasive particles have a median particle size of from about 1 to 250 micrometers and the median particle size ratio is about 2 or greater; and (b) subjecting said abrasive slurry to conditions sufficient to at least partially cure said binder precursor.

27. A method of making an abrasive article comprising the steps of:

(a) providing a production tool having a major surface said major surface having a plurality of precisely shaped recesses formed therein;

(b) filling said precisely shaped recesses with an abrasive slurry comprising:
- a binder precursor;
- a plurality of abrasive particles having a Mohs' hardness of 7 or greater randomly dispersed in said binder, said plurality of abrasive particles comprising at least:
  - a first grade of abrasive particles having a first median particle size; and
  - a second grade of abrasive particles having a second median particle size;
- wherein the abrasive particles have a median particle size of from about 1 to 250 micrometers and the median particle size ratio is about 2 or greater;

(c) providing a backing having a front and a back surface;

(d) laminating the front surface of said backing to the surface of said production tool so that at least a portion of the front surface of said backing is in direct contact with the surface of said production tool;

(e) subjecting said abrasive slurry to conditions sufficient to at least partially cure said binder precursor; and (f) separating said backing from said production tool.

28. A method of making an abrasive article according to claim 27 wherein step (f) is performed prior to step (e).

29. A method of making an abrasive article comprising the steps of:

(a) providing a production tool having a major surface said major surface having a plurality of precisely shaped recesses formed therein;

(b) filling said precisely shaped recesses with an abrasive slurry comprising:
- a binder precursor;
- a plurality of abrasive particles having a Mohs' hardness of 7 or greater randomly dispersed in said binder, said plurality of abrasive particles comprising at least:
  - a first grade of abrasive particles having a first median particle size; and
  - a second grade of abrasive particles having a second median particle size;

wherein the abrasive particles have a median particle size of from about 1 to 250 micrometers and the median particle size ratio is about 2 or greater;

(c) subjecting said abrasive slurry to conditions sufficient to at least partially cure said binder precursor so as to form precisely shaped composite particles;

(d) removing said precisely shaped composite particles from said precisely shaped recesses of said production tool;

(e) providing a backing having a front surface; and (f) adhering a plurality of said precisely shaped composite particles to the front surface of said backing with a make coat.

30. An abrasive slurry suitable for use in producing abrasive articles, said abrasive slurry comprising:

a radiation curable binder precursor;

a curing agent;

a plurality of abrasive particles having a Mohs' hardness of 7 or greater dispersed in said binder precursor, said plurality of abrasive particles comprising at least:

a first grade of abrasive particles having a first median particle size; and a second grade of abrasive particles having a second median particle size;

wherein the abrasive particles have a median particle size of from about 1 to 250 micrometers and the median particle size ratio is about 2 or greater.

31. An abrasive slurry in accordance with claim 30 wherein the median particle size ratio is about 3 or greater.

32. An abrasive slurry in accordance with claim 30 wherein the median particle size ratio is about 5 or greater.

33. An abrasive slurry in accordance with claim 30 wherein the median particle size ratio is about 7 or greater.

34. An abrasive article comprising:

a backing having a front and a back surface;

an abrasive coating bonded to the front surface of the backing said abrasive coating comprising:

a binder;

a plurality of abrasive particles having a Mohs' hardness of 7 or greater dispersed in said binder, said plurality of abrasive particles comprising at least:

a first grade of abrasive particles having a first median particle size; and a second grade of abrasive particles having a second median particle size;

wherein the abrasive particles have a median particle size of from about 1 to 250 micrometers and the size distribution of said plurality of abrasive particles contains at least two distinct bell-shaped curves.

35. A nonwoven abrasive article comprising:

an open, lofty, three-dimensional nonwoven web of fibers bound together at points of mutual contact;

a binder, and a plurality of composite particles bonded to said nonwoven web by said binder, each composite particle comprising a plurality of abrasive particles having a Mohs' hardness of 7 or greater dispersed in a binder, said plurality of abrasive particles comprising:

a first grade of abrasive particles having a first median particle size; and a second grade of abrasive particles having a second median particle size;

wherein the abrasive particles have a median particle size of from about 1 to 250 micrometers and the median particle size ratio is about 2 or greater.

* * * * *